US009284832B2

(12) United States Patent
DiFoggio

(10) Patent No.: US 9,284,832 B2
(45) Date of Patent: Mar. 15, 2016

(54) APPARATUS AND METHOD FOR DETERMINING INCLINATION AND ORIENTATION OF A DOWNHOLE TOOL USING PRESSURE MEASUREMENTS

(75) Inventor: Rocco DiFoggio, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 972 days.

(21) Appl. No.: 13/152,023

(22) Filed: Jun. 2, 2011

(65) Prior Publication Data

US 2012/0305313 A1 Dec. 6, 2012

(51) Int. Cl.
*E21B 47/024* (2006.01)
*E21B 47/06* (2012.01)

(52) U.S. Cl.
CPC ..... *E21B 47/024* (2013.01); *E21B 47/06* (2013.01)

(58) Field of Classification Search
CPC ..... E21B 44/00; E21B 47/00; E21B 7/04; E21B 7/00; E21B 7/046; E21B 47/02
USPC ..... 175/45, 40; 166/255.2, 250.07; 33/304, 33/306, 307, 313
See application file for complete search history.

(56) References Cited

U.S. PATENT DOCUMENTS 5,046,056 A * 9/1991 Sallas et al. ..... 367/166
5,646,611 A 7/1997 Dailey et al.
6,347,282 B2 2/2002 Estes et al.
6,490,802 B1 12/2002 Schutt
6,529,834 B1 3/2003 Estes et al.
7,055,255 B2 6/2006 Diaz
7,114,565 B2 10/2006 Estes et al.
7,195,062 B2 3/2007 Cairns et al.
7,685,732 B2 3/2010 Davies et al.
7,823,655 B2 11/2010 Boone et al.
8,359,185 B2 * 1/2013 Pita et al. ..... 703/9

(Continued)

FOREIGN PATENT DOCUMENTS

JP 57190211 11/1982
JP 2000065569 3/2000

OTHER PUBLICATIONS

For the American Heritage Dictionary definition: AT. (n.d.) The American Heritage® Dictionary of the English Language, Fourth Edition. (2003). Retrieved Apr. 29, 2014 from http://www.thefreedictionary.com/at.*
For the American Heritage Dictionary definition: estimate. (n.d.) American Heritage® Dictionary of the English Language, Fifth Edition. (2011). Retrieved Aug. 12, 2015 from http://www.thefreedictionary.com/estimate.*

(Continued)

*Primary Examiner* — Brad Harcourt
*Assistant Examiner* — Wei Wang
(74) *Attorney, Agent, or Firm* — Cantor Colburn LLP

(57) ABSTRACT

In one aspect, a method of estimating one of inclination and orientation of a downhole device is provided that includes the features of taking pressure measurements at a plurality of locations on the downhole device in the wellbore, wherein at least one location in the plurality of locations is vertically displaced from at least one other location, and estimating the one of the inclination and orientation of the downhole device from the plurality of pressure measurements. In another aspect, a downhole tool is disclosed that in one configuration includes a device for estimating inclination and/or orientation of the downhole tool that further includes a body containing a liquid therein and a plurality of pressure sensors arranged in the body configured to provide pressure measurements of the liquid in the body, wherein a pressure sensor in the plurality of pressure sensors is vertically disposed from at least one other sensor in the plurality of sensors.

15 Claims, 2 Drawing Sheets

(56) References Cited

U.S. PATENT DOCUMENTS

| | | | |
|---|---|---|---|
| 2008/0316860 | A1 | 12/2008 | Muyzert et al. |
| 2010/0187008 | A1 | 7/2010 | Wassermann et al. |
| 2011/0024187 | A1 | 2/2011 | Boone et al. |
| 2011/0024191 | A1 | 2/2011 | Boone |

OTHER PUBLICATIONS

International Search Report and Written Opinion dated Nov. 23, 2012 for International Applicatoin No. PCT/US2012/040457; all references in PCT are cited above.

* cited by examiner

APPARATUS AND METHOD FOR DETERMINING INCLINATION AND ORIENTATION OF A DOWNHOLE TOOL USING PRESSURE MEASUREMENTS

BACKGROUND OF THE DISCLOSURE

1. Field of the Disclosure

The present disclosure is related to apparatus and methods for estimating inclination and orientation of a tool in a wellbore.

2. Description of the Related Art

Wellbores are drilled in earth's formations for the production of hydrocarbons (oil and gas). A large number of wells are deviated wells or horizontal wells. A typical profile for such wells may include a vertical section, a deviated or inclined section and a horizontal or substantially horizontal section. The drilling of such wellbores is accomplished by a drill string that includes a drilling assembly (also referred to as a bottomhole assembly or BHA) that includes a drill bit attached to its bottom end. The drill bit is rotated by rotating the drill string from the surface and or by rotating the drill bit with a drilling motor (also referred to as a "mud motor") in the drilling assembly. Measurements made by multi-axis accelerometers and magnetometers in the drilling assembly are used to determine the inclination and orientation (azimuthal direction) of the drilling assembly in the formation relative to a reference, such as geographical north. The drilling assembly typically includes one or more steering devices for maintaining the drilling assembly along the desired well path or well profile, based on the determined inclination and orientation of the drilling assembly.

The disclosure herein provides an apparatus and method of determining inclination and orientation of a tool, such as the drilling assembly, using pressure measurements made downhole.

SUMMARY OF THE DISCLOSURE

In one aspect, a method of estimating one of inclination and/or orientation of a downhole tool is provided, which in one embodiment includes: taking pressure measurements at a plurality of locations associated with the tool in the wellbore, wherein at least one location in the plurality of locations is vertically displaced from at least one other location, and estimating the inclination and/or orientation of the tool from the plurality of pressure measurements.

In another aspect, a downhole tool is disclosed that in one configuration includes a device for estimating inclination and/or orientation of the downhole tool, wherein the device includes a body containing a liquid therein and a plurality of pressure sensors arranged in the body configured to provide pressure measurements of the liquid in the body. In another aspect, the device includes a processor configured to estimate the inclination and/or orientation from the pressure measurements.

Examples of certain features of the apparatus and method disclosed herein are summarized rather broadly in order that the detailed description thereof that follows may be better understood. There are, of course, additional features of the apparatus and method disclosed hereinafter that will form the subject of the claims.

BRIEF DESCRIPTION OF THE DRAWINGS

For detailed understanding of the present disclosure, references should be made to the following detailed description, taken in conjunction with the accompanying drawings, in which like elements have been given like numerals and wherein.

DETAILED DESCRIPTION OF THE DISCLOSURE

Figure 1:
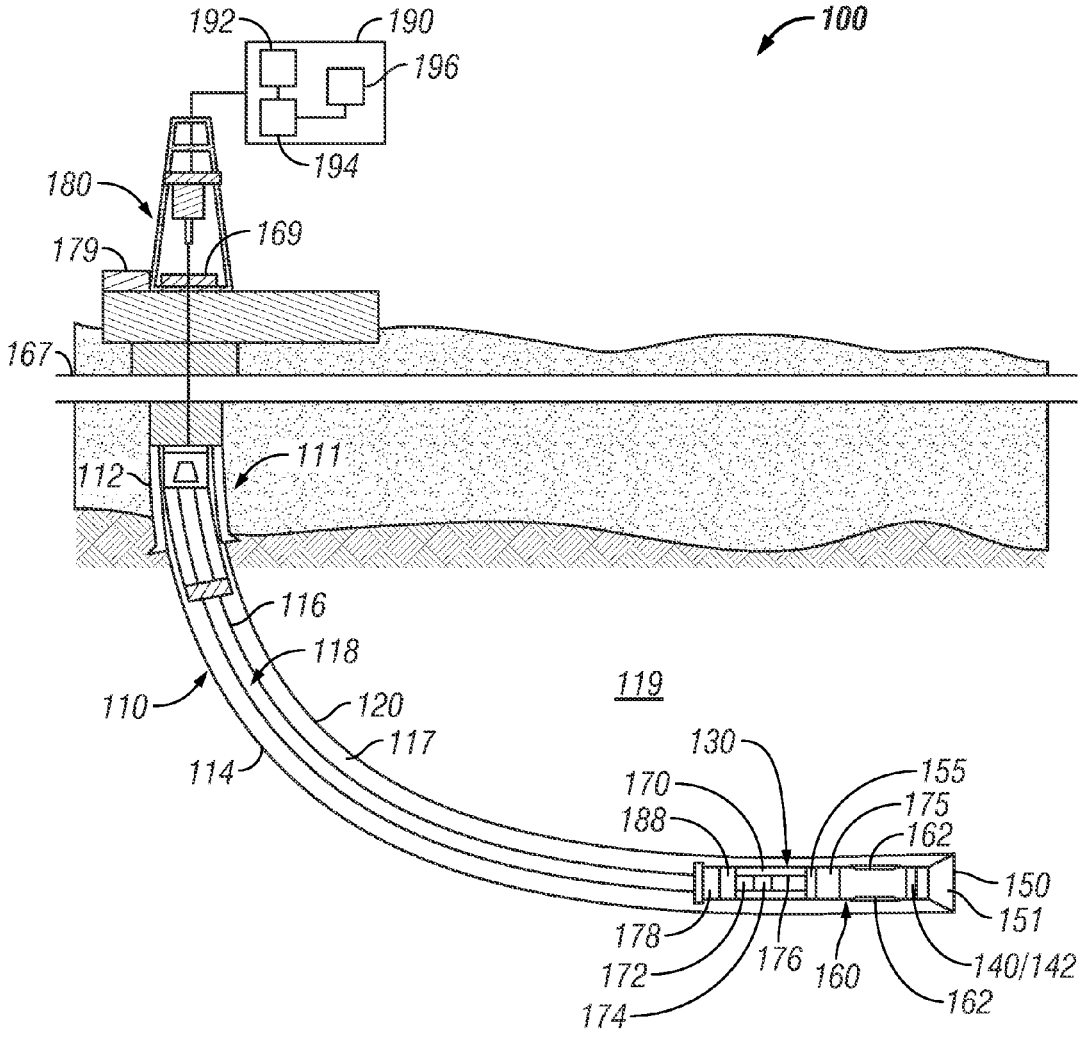
FIG. 1 is a schematic diagram of an exemplary drilling system for drilling a wellbore that incorporates a device in a downhole tool for determining inclination and/or orientation of the downhole tool during drilling of the wellbore, according to one embodiment of the disclosure.

FIG. 1 is a schematic diagram of an exemplary drilling system 100 that is configured to include a downhole tool that incorporates devices to determine the inclination and/or orientation of a tool in the wellbore during drilling, and to drill the wellbore along a desired wellbore path in response to the determined inclination and orientation. FIG. 1 shows a wellbore 110 that includes an upper section 111 with a casing 112 installed therein and a lower section 114 that is being drilled with a drill string 118. The drill string 118 includes a tubular member 116 that carries a drilling assembly 130 at its bottom end. The tubular member 116 may be made by joining drill pipe sections or a coiled-tubing. A drill bit 150 is attached to the end of the drilling assembly 130 to drill the wellbore 110 of a selected diameter in a formation 119. The drilling assembly 130 includes a steering device 160 that may be controlled during drilling of the wellbore 110 to steer the drill bit 150 and thus the drilling assembly 130 along a desired direction or well path. In a particular configuration, the steering device 160 may include a number of independently controlled force application members 162 configured to steer the drill bit in the desired direction. Any other steering device may be utilized for purposes of this disclosure.

Drill string 118 is shown conveyed into the wellbore 110 from an exemplary rig 180 at the surface 167. The rig 180 shown in FIG. 1 is a land rig for ease of explanation. The apparatus and methods disclosed herein may also be utilized with rigs used for drilling offshore wellbores. A rotary table 169 or a top drive 168 coupled to the drill string 118 at the surface may be utilized to rotate the drill string 118 and thus the drilling assembly 130 and the drill bit 150 to drill the wellbore 110. A drilling motor 155 (also referred to as "mud motor") may also be provided to rotate the drill bit 150. A control unit (or controller) 190, which may be a computer-based unit, may be placed at the surface 167 for receiving and processing data transmitted by the various sensors and measurement-while-drilling ("MWD") devices (collectively designated by numeral 175) in the drilling assembly 130 and for controlling selected operations of the various devices and sensors in the drilling assembly 130, including the steering device 160. The surface controller 190, in one embodiment, may include a processor 192, such as microprocessor, and a data storage device (a "computer-readable medium") 194 for storing data and computer programs 196. The data storage device 194 may be any suitable device, including, but not limited to, a read-only memory (ROM), a random-access memory (RAM), a flash memory, a magnetic tape, a hard disc and an optical disk. To drill a wellbore, a drilling fluid from a drilling fluid source 179 is pumped under pressure into the tubular member 116. The drilling fluid discharges at the bottom of the drill bit 150 and returns to the surface 167 via the annular space (also referred as the "annulus") 117 between the drill string 118 and the inside of the wellbore 110.

Still referring to FIG. 1, the drill bit 150 may include a sensor 140 for providing a plurality of pressure measurements at selected locations associated with the BHA 130. A circuit 142 pre-processes the pressure measurements and provides the processed signals to a controller 170 for estimating the inclination and/or orientation of the drilling assembly during drilling of the wellbore 110. The controller 170 may be configured to process signals from the circuit 142 and other sensors and MWD devices 175. The controller 170 may include a processor 172, such as a microprocessor, a data storage device 174 and a program 176 for use by the processor 172 to process downhole data. In aspects, the controller 170 may process data to estimate downhole parameters, including the inclination and orientation communicate the results to the surface controller via a telemetry unit 188. In other aspects, the controller 170 may be configured to partially process selected downhole data and communicate the results to the controller 190 for further processing. The controllers 170 and 190 may cooperate with each other to control various operations of the drilling assembly, including controlling the steering device to drill the wellbore along a desired direction in response to the inclination and orientation of the drilling assembly determined using measurements made by the sensor 140. In aspects, the telemetry unit 188 provides two-way communication between the surface and the drilling assembly drilling assembly. Any suitable telemetry system may be utilized for the purpose of this disclosure. Exemplary telemetry system may include mud pulse telemetry, acoustic telemetry, electromagnetic telemetry, and a system wherein one or more conductors positioned along the drill string 118 (also referred to as wired-pipe). The conductors may include metallic wires, fiber optical cables, or other suitable data carriers. A power unit 178 provides power to the electrical sensors, MWD devices and circuits in the drilling assembly. In one embodiment, the power unit 178 may include a turbine driven by the drilling fluid 179 and an electrical generator.

Figure 2:
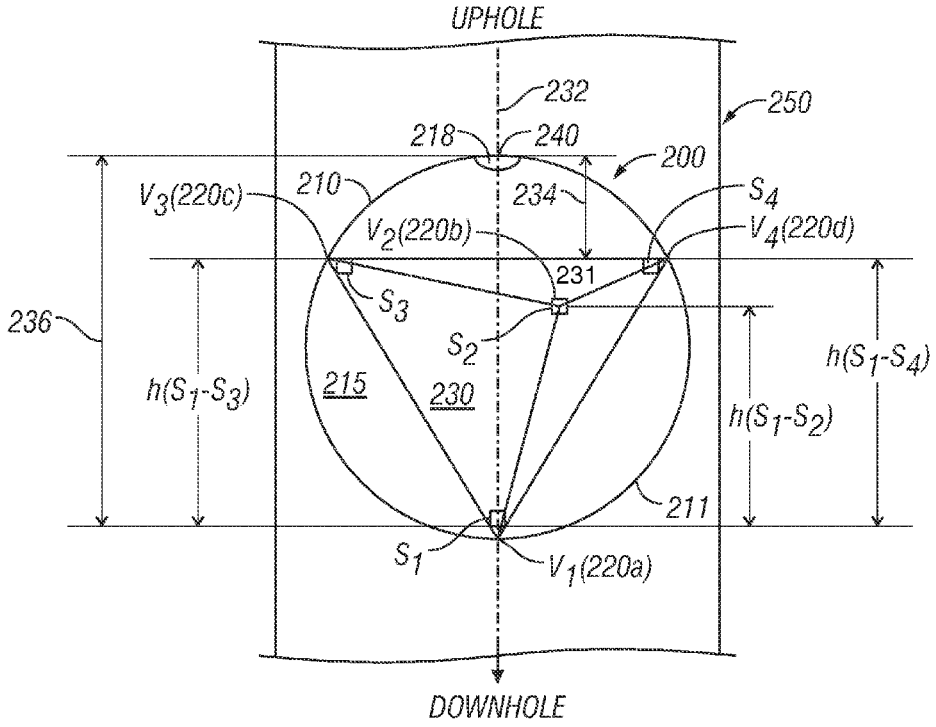
FIG. 2 shows a sensor made according to one embodiment of the disclosure that may be utilized in the downhole tool of FIG. 1 for providing pressure measurements at a plurality of locations associated with the downhole tool.

FIG. 2 shows a sensor 200 made according to one embodiment and placed in a downhole tool 250 for determining inclination and/or orientation of the tool 250 during drilling of a wellbore. In one aspect, the sensor 200 includes a body 210 (such as a sphere or spherical body) filled with a suitable fluid 215, which may be a substantially non-compressible liquid, such as oil. A portion 218 of the sphere 210 is shown empty or unfilled with the fluid 215 to allow for the expansion of the fluid 215 up to a desired or selected temperature, such as up to 200° C. or 300° C. The sensor 200 is shown to include a number of pressure sensors $S_1$, $S_2$, $S_3$ and $S_4$ placed spaced apart in the sphere 210 to provide signals representative of the pressure of the liquid 215 inside the sphere 210. The diameter of the sphere 210 is selected based on the available space in the tool 250 and the intended application. In a particular configuration, the sphere 210 may be between 30 mm-50 mm in diameter, which generally is suitable for use in tools for use in wellbores, such as drilling assemblies. The sensors $S_1$-$S_4$ may be placed in the sphere 210 by any suitable manner, such as by screws, etc. In one aspect, sensors $S_1$-$S_4$ penetrate a relatively small distance (about 2-5 mm) into the shell 211 of the sphere 210, with their pressure-sensing elements geometrically arranged at the vertices of a regular tetrahedron 230. In the particular sensor 200, sensors $S_1$, $S_2$, $S_3$ and $S_4$ are shown placed in the sphere 210 to respectively sense pressure at vertices $V_1$, $V_2$, $V_3$ and V4 (220*a*, 220*b*, 222*c* and 220*d*) of the regular tetrahedron 230. The pressure measured at each vertex may be represented by ρgh, where ρ is the density of the fluid 215, g is the acceleration of gravity, and h is the submersion depth of the particular pressure sensor within the fluid 215. As the inclination and orientation of the tool 250 changes in the wellbore, the immersion depth, $h_i$, of the ith pressure sensor within the fluid 215 would change based on the change in inclination and orientation. A change in the immersion depth would cause the pressure at such location to change and thus the output signal of the pressure sensor at such location. When the sensor 200 is in the vertical position, such as shown in FIG. 2, the sensors $S_2$, $S_3$ and $S_4$ lie in a common plane 231, of the regular tetrahedron, which plane is perpendicular (orthogonal) to the vertical axis 232 of the sphere 210. In FIG. 2, the axis 232 is shown to be the same axis as the longitudinal axis of the tool 250. In such a vertical position, the pressure at the vertices $V_2$, $V_3$ and $V_4$ is the same, because the height 234 of the fluid in the sphere 210 above each such sensor is the same. In the vertical position, pressure at sensor $S_1$ will correspond to the height 236 of the fluid, which height is the diameter of the sphere 210. Thus, in this vertical position, the pressure difference between the pressure at vertex $V_1$ and vertices $V_2$, $V_3$ and V4 will be $\rho g\,(h_{236}-h_{234})$.

Still referring to FIG. 2, a change in the orientation of sensor 200 may be described as a series of rotations by three Euler angles. In one method, the orientation of the tool 250 may be estimated or determined by Euler angles associated with the immersion depths $h_1$, $h_2$, $h_3$, and $h_4$ of sensors $S_1$, $S_2$, $S_3$ and $S_4$ respectively that best correlate to the measured pressure values, $P_1$, $P_2$, $P_3$, and $P_4$ respectively at vertices $V_1$, $V_2$, $V_3$ and $V_4$. In this method, different Euler angle combinations may be tried until an angle combination is obtained for which a straight-line fit between $P_i$ and $h_i$ is best, which will occur when the value of R squared is the largest. To reduce or minimize the number of Euler angle combination guesses to be tested (i.e., number of iterations performed), a multi-variable optimization algorithm may be utilized. One such algorithm is know as Generalized Reduced Gradient (GRG2) algorithm, which is incorporated under trade name Solver in a commercially available application program referred to as "Microsoft Excel" from Microsoft Corporation. This algorithm begins with a first guess for the Euler angles and a second guess for the Euler angles. From the partial derivatives for the change in R squared with each change in the Euler angle, the algorithm determines the maximum gradient, which is then used to prepare the next guess for each Euler angle and so on. This process is repeated iteratively until it converges to a solution. Any other model or algorithm may be utilized to determine the orientation from the pressure measurement. Although the sensor 200 shown in FIG. 2 is in the form of a sphere in which the sensors measure pressure of the fluid at vertices of a regular tetrahedron 230, any other shape and placement of sensors may be utilized for the purpose of this disclosure. The inclination of axis 232 from the vertical may be estimated or determined from the change in pressure at sensor $S_1$. The maximum pressure at $S_1$ is when the sensor 200 is in the vertical position. When the tool 250 tilts, the pressure at $S_1$ will correspond to the height $h_1$. When the tool 250 is in the horizontal position (i.e. when the inclination relative to the vertical is 180 degrees) the pressure at S1 will be the least. In the horizontal position the pressure at vertex $V_1$ will be the same as the pressure at the top 240 of the sphere 210. The pressure between these two extremes will be proportional (linear relation) to the value of $h_1$. In operation, each of the pressure sensors $S_1$-$S_4$ provides a signal corresponding to the pressure measured by such sensor. For example, signal 220*a* is provided by sensor S1, signal 220*b* by sensor S2, signal 220*c* by sensor S3 and signal 220*d* by sensor S4. Such signals may be processed by any suitable circuitry to estimate the inclination and/or orientation of the tool 250.

Figure 3:
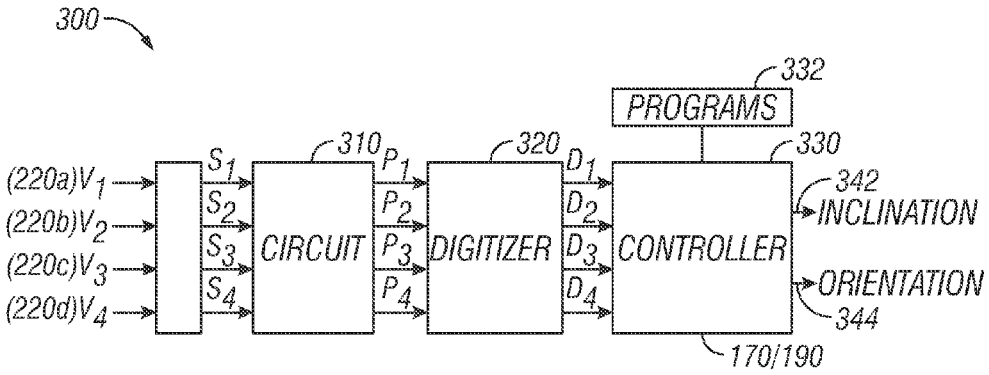
FIG. 3 shows a circuit that includes a processor configured to process pressure measurements from the pressure sensors of the device shown in FIG. 2 to estimate inclination and/or orientation of the downhole tool.

FIG. 3 shows an exemplary circuit 300 configured to process pressure measurements from the pressure sensors $S_1$-$S_4$ of sensor 200 to estimate inclination and/or orientation of a downhole tool, such as tool 250. The circuit 300 may be placed at any suitable location in the tool 250. In one aspect, signals 220*a*, 220*b*, 220*c* and 220*d* respectively from sensors $S_1$-$S_4$ may be pre-amplified and conditioned by a circuit 310. In one configuration, circuit 310 may provide analog signals $P_1$ corresponding to pressure measured by sensor $S_1$, signals $P_2$ corresponding to pressure measured by sensor $S_2$, signals $P_3$ corresponding to pressure measured made by sensor $S_3$ and signals $P_4$ corresponding to pressure measured by sensor $S_4$. A digitizer 320 may be utilized to digitize the $P_1$, $P_2$, $P_3$ and $P_4$ and provide corresponding digitized signals $D_1$, $D_2$, $D_3$ and $D_4$ to a controller 330. Controller 330 may be controller 170 (FIG. 1) and/or controller 140 at the surface (FIG. 1). The controller 330 may be a microprocessor configured to processes signals $D_1$, $D_2$, $D_3$ and $D_4$ utilizing programs 332 in the manner described above in reference to FIG. 2 to estimate or determine the inclination 342 and/or orientation 344 of the downhole tool 250 when the tool is in the wellbore.

Thus, in aspects, the disclosure provides a method of estimating or determining inclination and/or orientation (tool face) of a device or tool in a wellbore, which method, in one embodiment, includes: taking pressure measurements at a plurality of locations associated with the tool in the wellbore, wherein at least one location in the plurality of locations is vertically displaced from at least one other location; and estimating the inclination and/or orientation of the tool from the plurality of pressure measurements. In one aspect, taking the pressure measurements includes taking the pressure measurements at a plurality of locations corresponding to plurality of vertices of a tetrahedron. In another aspect the plurality of locations are inside a fluid body. In one configuration, the fluid body is a sphere and the fluid is a relatively incompressible liquid. In another aspect, the pressure measurements are taken by sensors inserted into the liquid in the spherical body. In one aspect, estimating the inclination and/or orientation comprises determining pressure as ρgh, where ρ is density of the fluid, g is the acceleration of gravity, and h is immersion depth of each pressure sensor within the fluid. In yet another aspect, the method includes using changes in the immersion depth of the pressure sensors to estimate the one of inclination and orientation of the downhole device. In yet another aspect, estimating the inclination or orientation comprises: estimating changes in pressure measurements in at least one of the pressure measurements; determining Euler angles associated with immersion depths of the plurality of sensors; and correlating the immersion depths with the pressure measurements to estimate the one of the inclination and orientation of the tool. In one aspect, the correlating the immersion depths with the pressure measurements comprises performing a curve fitting between the immersion depths and the pressure measurements.

In another aspect, a tool is disclosed that in one configuration includes a device for estimating inclination and/or orientation of the tool. The device for determining inclination and orientation, in one configuration, includes a body containing a liquid therein and a plurality of pressure sensors arranged in the body configured to provide pressure measurements of the liquid in the body, wherein a pressure sensor in the plurality of pressure sensors is vertically displaced for at least one other sensor, which occurs whenever not all of the pressure sensors lie on a single plane. In one configuration, a pressure sensor in the plurality of pressure sensors is vertically disposed from at least one other pressure sensor. Another configuration of the tool may include a plurality of pressure sensors with a pressure sensor vertically displaced from at least one of the other pressure sensors; a circuit configured to provide signals corresponding to pressure measurements of the plurality of pressure sensors when the tool is in a non-vertical position in the wellbore; and a circuit configured to estimate inclination and/or orientation of the tool using the pressure measurements. In one configuration the plurality of pressure sensors are arranged at vertices of a tetrahedron defined in a liquid-filled spherical body. In one aspect, the spherical body is configured to allow for thermal expansion of the liquid up to a selected temperature. In one configuration, a sensor in the plurality of pressure sensors aligns with a longitudinal axis of the tool and the remaining pressure sensors are in a plane perpendicular to the longitudinal axis of the downhole tool. In one aspect, the processor is further configured to estimate the inclination and/or orientation of the tool using pressure values computed as ρgh, where ρ is density of the fluid, g is the acceleration of gravity, and h is immersion depth of each pressure sensor within the fluid. In another aspect, the processor is further configured to utilize changes in the immersion depth of the pressure sensors to estimate the inclination and/or orientation of the tool. The processor may further be configured to estimate the inclination and/or orientation by: estimating changes in pressure measurements in at least one of the pressure measurements; determining Euler angles associated with immersion depths of the plurality of pressure sensors; and correlating the immersion depths with the pressure measurements to estimate the inclination and/or orientation of the tool. In yet another aspect a device for use in estimating inclination and/or orientation of a tool is provided, which device, in one configuration includes: a body containing a liquid therein; and a plurality of pressure sensors configured to provide pressure measurements of the liquid in the body, wherein a pressure sensor in the plurality of pressure sensors is vertically disposed from at least one other sensor in the plurality of pressure sensors. In one configuration, the pressure sensors in the plurality of pressure sensors are located at vertices of a tetrahedron. In one aspect, all but one pressure sensor in the plurality of pressure sensors is at the same pressure when the device is in a neutral position. In another aspect, the device comprises a processor configured to estimate the inclination and/or orientation by: estimating changes in the pressure measurements in at least one of the pressure measurements; determining Euler angles associated with immersion depths of the plurality of pressure sensors; and correlating the immersion depths with the pressure measurements to estimate the one of the inclination and orientation of the downhole device. In yet another aspect, a system for drilling a wellbore is provided. The system, in one embodiment, includes: a drill string having a bottomhole assembly; a device for determining inclination and/or orientation of the bottomhole assembly that includes a plurality of pressure sensors and circuit configured to estimate inclination and/or orientation using measurements form the pressure sensors.

While the foregoing disclosure is directed to the preferred embodiments of the disclosure, various modifications will be apparent to those skilled in the art. It is intended that all variations within the scope and spirit of the appended claims be embraced by the foregoing disclosure.

What is claimed is:

1. A method of estimating one of inclination and orientation of a downhole device, the method, comprising:

taking pressure measurements using pressure sensors at a plurality of locations on the downhole device in the wellbore, wherein at least one location in the plurality of locations is vertically displaced from at least one other location, and the pressure sensors measure pressure of a non-compressible liquid filled volume disposed within a sphere, wherein the sphere contains the non-compressible liquid filled volume and a thermal expansion volume configured to allow the non-compressible liquid filled volume to expand to occupy substantially an entire volume of the sphere at a downhole temperature; and estimating the one of the inclination and orientation of the downhole device from the plurality of pressure measurements, wherein estimating the one of inclination and orientation comprises determining pressure as $\rho gh$, where $\rho$ is density of the substantially non-compressible liquid, g is the acceleration of gravity, and h is immersion depth of each pressure sensor within the substantially non-compressible liquid.

2. The method of claim 1, wherein taking pressure measurements comprises taking the pressure measurement at a plurality of locations corresponding to a plurality of vertices of a tetrahedron.

3. The method of claim 1 further comprising using changes in the immersion depth of the pressure sensors to estimate the one of inclination and orientation of the downhole device.

4. The method of claim 1 wherein estimating the one of inclination and orientation comprises:

estimating changes in the pressure measurements in at least one of the pressure measurements;

determining Euler angles associated with immersion depths of the plurality of pressure sensors; and correlating the immersion depths with the pressure measurements to estimate the one of the inclination and orientation of the downhole device.

5. The method of claim 4, wherein correlating the immersion depths with the pressure measurements comprises performing curve filling between the immersion depths and the pressure measurements.

6. An apparatus for use in a wellbore for estimating one of inclination and orientation of a downhole tool in the wellbore, comprising:

a plurality of pressure sensors, wherein a first pressure sensor in the plurality of pressure sensors is vertically displaced from at least one of other pressure sensors, and the pressure sensors measure pressure of a non-compressible liquid filled volume disposed within a sphere, wherein the sphere contains the non-compressible liquid filled volume and a thermal expansion volume configured to allow the non-compressible liquid filled volume to expand to occupy substantially an entire volume of the sphere at a downhole temperature;

a circuit configured to provide signals corresponding to pressure measured by the plurality of pressure sensors when the downhole tool is in a non-vertical position in the wellbore; and a processor configured to estimate the one of inclination and orientation of the downhole tool using pressure measurements, wherein the processor is further configured to estimate the one of inclination and orientation using pressure values computed as $\rho gh$, where $\rho$ is density of the substantially non-compressible liquid, g is the acceleration of gravity, and h is immersion depth of each pressure sensor within the substantially non-compressible liquid.

7. The apparatus of claim 6, wherein the plurality of pressure sensors are arranged in the sphere at vertices of a tetrahedron.

8. The apparatus of claim 7, wherein the sphere contains the substantially non-compressible liquid in an amount that allows for thermal expansion of the substantially non-compressible liquid therein up to a selected temperature.

9. The apparatus of claim 6 wherein a pressure sensor in the plurality of pressure sensors is placed at a longitudinal axis of the downhole tool and the remaining sensors are placed in a plane perpendicular to the longitudinal axis of the downhole tool.

10. The apparatus of claim 6, wherein the processor is further configured to utilize changes in the immersion depth of the pressure sensors to estimate the one of inclination and orientation of the downhole tool.

11. The apparatus of claim 6, wherein the processor is further configured to estimate the one of inclination and orientation by:

estimating changes in the pressure measurements in at least one of the pressure measurements;

determining Euler angles associated with immersion depths of the plurality of pressure sensors; and correlating the immersion depths with the pressure measurements to estimate the one of the inclination and orientation of the downhole tool.

12. An apparatus for estimating at least one of inclination and orientation of a tool in a wellbore, comprising:

a spherical body containing a non-compressible liquid filled volume and a thermal expansion volume configured to allow the non-compressible liquid filled volume to expand to occupy substantially an entire volume of the spherical body at a downhole temperature;

a plurality of pressure sensors arranged in the spherical body configured to provide pressure measurements of the non-compressible liquid filled volume, wherein a pressure sensor in the plurality of pressure sensors is vertically disposed from at least one other pressure sensor in the plurality of pressure sensors; and a processor configured to estimate the one of inclination and orientation of the tool using pressure measurements, wherein the processor is further configured to estimate the one of inclination and orientation using pressure values computed as $\rho gh$, where $\rho$ is density of the substantially non-compressible liquid, g is the acceleration of gravity, and h is immersion depth of each pressure sensor within the substantially non-compressible liquid.

13. The apparatus of claim 12, wherein each of the pressure sensors in the plurality of pressure sensors is located at a vertex of a tetrahedron.

14. The apparatus of claim 12, wherein in a neutral position of the spherical body, all except one pressure sensor in the plurality of pressure sensors provide the same pressure measurement.

15. The apparatus of claim 14 wherein the processor is configured to estimate the one of inclination and orientation by:

estimating changes in the pressure measurements in at least one of the pressure measurements;

determining Euler angles associated with immersion depths of the plurality of pressure sensors; and correlating the immersion depths with the pressure measurements to estimate the one of the inclination and orientation of the tool.

* * * * *